US009134094B2

(12) United States Patent
Hilbourne et al.

(10) Patent No.: US 9,134,094 B2
(45) Date of Patent: Sep. 15, 2015

(54) LASER AIMING DEVICE

(75) Inventors: Zackary Hilbourne, Wilsonville, OR (US); Jason Hilbourne, Wilsonville, OR (US); Daniel Hughes, Wilsonville, OR (US); Danny Anderson, Wilsonville, OR (US)

(73) Assignee: Crimson Trace Corporation, Wilsonville, OR (US)

( * ) Notice: Subject to any disclaimer, the term of this patent is extended or adjusted under 35 U.S.C. 154(b) by 0 days.

(21) Appl. No.: 13/812,294

(22) PCT Filed: Jul. 27, 2011

(86) PCT No.: PCT/US2011/045625

§ 371 (c)(1),
(2), (4) Date: Apr. 1, 2013

(87) PCT Pub. No.: WO2012/015983

PCT Pub. Date: Feb. 2, 2012

(65) Prior Publication Data

US 2013/0185982 A1 Jul. 25, 2013

Related U.S. Application Data

(60) Provisional application No. 61/368,079, filed on Jul. 27, 2010.

(51) Int. Cl.

| | |
|---|---|
| ***F41G 1/36*** | (2006.01) |
| ***F41G 1/35*** | (2006.01) |
| ***F41G 11/00*** | (2006.01) |

(52) U.S. Cl.

CPC .. *F41G 1/36* (2013.01); *F41G 1/35* (2013.01); *F41G 11/00* (2013.01)

(58) Field of Classification Search

CPC ..... F41G 1/35; F41G 1/36
USPC ..... 42/114, 113, 117, 115, 146, 147
See application file for complete search history.

(56) References Cited

U.S. PATENT DOCUMENTS

| | | | | |
|---|---|---|---|---|
| 5,355,608 | A * | 10/1994 | Teetzel | 42/117 |
| 5,355,609 | A | 10/1994 | Schenke | |
| 5,481,819 | A * | 1/1996 | Teetzel | 42/117 |
| 5,822,905 | A | 10/1998 | Teezel | |
| 6,431,731 | B1 | 8/2002 | Krietzman | |
| 7,726,061 | B1 * | 6/2010 | Thummel | 42/115 |
| 7,753,549 | B2 * | 7/2010 | Solinsky et al. | 362/110 |

(Continued)

OTHER PUBLICATIONS

International Search Report for Application No. PCT/US2011/045625, 3 pages.

*Primary Examiner* — Reginald Tillman, Jr.
(74) *Attorney, Agent, or Firm* — Schwabe, Williamson & Wyatt, P.C.

(57) ABSTRACT

Embodiments herein relate to the field of firearms, and, more specifically, to laser sights for firearms, particularly laser sights having multiple laser diodes. Various embodiments of the disclosed systems may include two or more lasers in a single unit, and may not only be relatively less expensive relative to units with two separate lasers and housings, but they may also be easier to calibrate and use. For example, in various embodiments, the system may include two or more lasers that may be adjusted for windage and elevation (e.g., calibrated) simultaneously. Thus, in various embodiments, one or more infrared diodes may be calibrated automatically when a corresponding visible light diode is calibrated, and vice versa.

8 Claims, 4 Drawing Sheets

(56) References Cited

U.S. PATENT DOCUMENTS

2002/0194767 A1* 12/2002 Houde-Walter et al. ..... 42/114
2008/0000133 A1 1/2008 Solinsky et al.
2008/0202010 A1* 8/2008 Matthews et al. ..... 42/115
2012/0216440 A1* 8/2012 Riley et al. ..... 42/146

* cited by examiner

LEFT GRIP SWITCH (LASER MODE) = RED
RIGHT GRIP SWITCH (POWER) = ON
RESULT = RED LASER FIRES

LEFT GRIP SWITCH (LASER MODE) = IR
RIGHT GRIP SWITCH (POWER) = ON
RESULT = IR LASER FIRES

LEFT GRIP SWITCH (LASER MODE) = RED
RIGHT GRIP SWITCH (POWER) = OFF
RESULT = NO LASERS

LEFT GRIP SWITCH (LASER MODE) = IR
RIGHT GRIP SWITCH (POWER) = OFF
RESULT = NO LASERS

LASER AIMING DEVICE

CROSS REFERENCE TO RELATED APPLICATION

The present application is a U.S. National Stage of International Patent Application No. PCT/US2011/045625, filed Jul. 27, 2011, entitled "Laser Aiming Device" and which claims the benefit of U.S. Provisional Patent Application No. 61/368,079, filed Jul. 27, 2010, entitled "Dual Laser Diode Assembly," these disclosures of which are hereby incorporated by reference in their entireties.

TECHNICAL FIELD

Embodiments herein relate to the field of firearms, and, more specifically, to laser sights for firearms, particularly laser sights having multiple laser diodes.

BACKGROUND

Lasers have been used in many firearms applications as tools to enhance targeting. For example, one form of firearm sight makes use of a laser placed on a handgun or a rifle and aligned to emit a beam parallel to the barrel. Since a laser beam by definition has low divergence, the laser light appears as a small spot even at long distances. The user places the spot on the desired target and the barrel of the gun is aligned (but not necessarily allowing for bullet drop or movement of the target while the bullet travels).

Most laser sights use a red laser diode. Others use an infrared diode to produce a dot invisible to the naked human eye but detectable with night vision devices. Many sights can be calibrated in order to precisely align them with the barrel of the firearm. However, it is difficult to calibrate (e.g., "sight") an infrared laser due to the need for special infrared vision gear, and the procedure cannot be carried in daylight. Furthermore, dual red/infrared sights must be sighted twice: once to align the red laser diode and a second time to align the infrared laser diode.

Additional problems with laser sights is that they can render the firearm incompatible with a holster, they can be awkward to use, and activation of the sight can require grip changes that interfere with quick and effective shooting procedures.

BRIEF DESCRIPTION OF THE DRAWINGS

Embodiments will be readily understood by the following detailed description in conjunction with the accompanying drawings. Embodiments are illustrated by way of example and not by way of limitation in the figures of the accompanying drawings.

DETAILED DESCRIPTION OF DISCLOSED EMBODIMENTS

Figure 1:
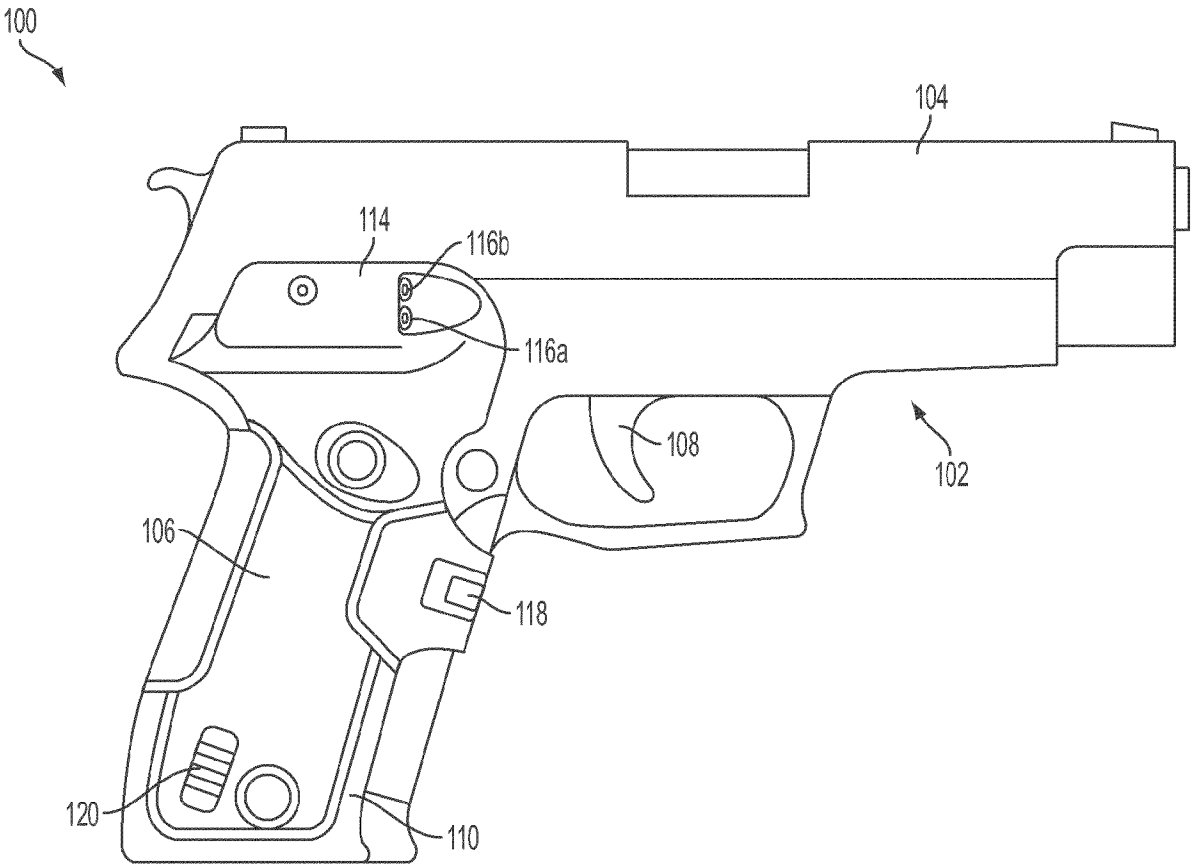
FIG. 1 is a schematic diagram illustrating an exemplary laser aiming system in use with an exemplary handgun, in accordance with various embodiments.

In the following detailed description, reference is made to the accompanying drawings which form a part hereof, and in which are shown by way of illustration embodiments that may be practiced. It is to be understood that other embodiments may be utilized and structural or logical changes may be made without departing from the scope. Therefore, the following detailed description is not to be taken in a limiting sense, and the scope of embodiments is defined by the appended claims and their equivalents.

Various operations may be described as multiple discrete operations in turn, in a manner that may be helpful in understanding embodiments; however, the order of description should not be construed to imply that these operations are order dependent.

The description may use perspective-based descriptions such as up/down, back/front, and top/bottom. Such descriptions are merely used to facilitate the discussion and are not intended to restrict the application of disclosed embodiments.

The terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

For the purposes of the description, a phrase in the form "NB" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB) that is, A is an optional element.

The description may use the terms "embodiment" or "embodiments," which may each refer to one or more of the same or different embodiments. Furthermore, the terms "comprising," "including," "having," and the like, as used with respect to embodiments, are synonymous.

Embodiments herein provide laser aiming systems that may provide a user with a substantial tactical advantage that may allow a handgun to be employed in a variety of day and night applications. Various embodiments of the disclosed systems may include two or more lasers in a single unit, and may not only be relatively less expensive relative to units with two separate lasers and housings, but they may also be easier to calibrate and use. For example, in various embodiments, the system may include two or more lasers that may be adjusted for windage and elevation (e.g., calibrated) simultaneously. Thus, in various embodiments, one or more infrared diodes may be calibrated automatically when a corresponding visible light diode is calibrated, and vice versa.

In various embodiments, the laser system may be a handgun grip-integrated system that may provide both an infrared (IR) laser and a visible light laser in a single, small, lightweight, ergonomic system. In use, either laser type may be selected with the quick activation of a switch, which may be located on the grip in some examples. In various embodiments, this switch placement may allow the system to easily transition between different lighting conditions and applications, with or without the use of auxiliary night vision goggles, at a moment's notice. Various embodiments of the system also may provide excellent compatibility with holsters. Further embodiments also may provide actuation systems that may be instinctive for the user to use, and that may be used without disrupting either the user's grip or the quick, effective shooting procedures that may be required in a variety of environments. Thus, systems in accordance with the present disclosure may provide efficient toggling between lasers to suit any light conditions; a very small size and weight; easy installation, maintenance, and implementation; easy calibration; excellent battery life; excellent ergonomics; and excellent durability and reliability.

Figure 2B:
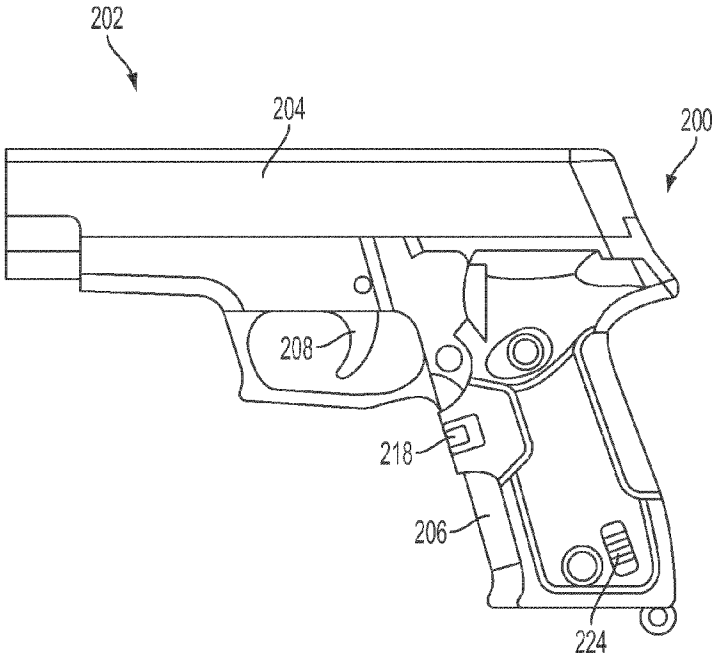
FIGS. 2A and 2B are right (FIG. 2A) and left (FIG. 2B) side views of an exemplary laser aiming system in use with an exemplary handgun, in accordance with various embodiments.
Figure 2A:
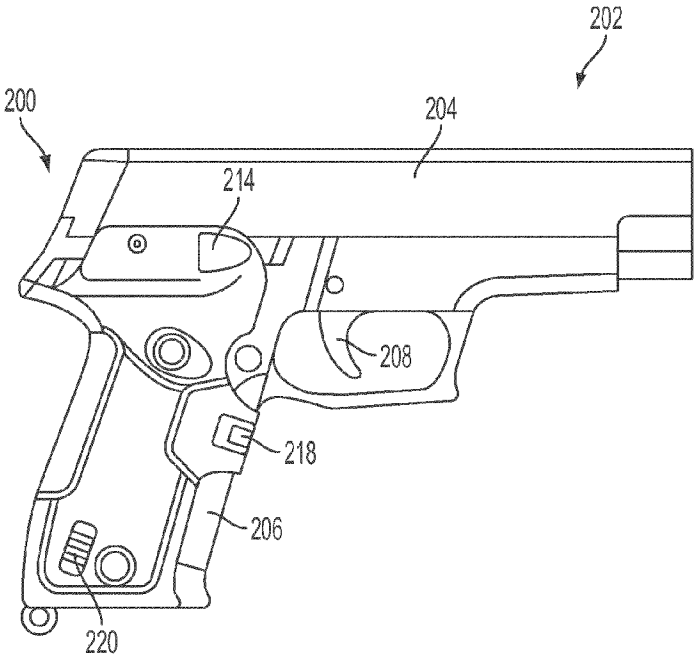

FIG. 1 is a schematic diagram illustrating an exemplary laser aiming system in use with an exemplary handgun; FIGS. 2A and 2B are right (FIG. 2A) and left (FIG. 2B) side views of an exemplary dual aiming laser system in use with an exemplary handgun; FIG. 3 is a master switch state diagram showing an exemplary laser aiming system; and FIGS. 4A, 4B and 4C are ISO views of three different examples of a dual laser component, all in accordance with various embodiments.

As shown in FIG. 1, in various embodiments, the laser system 100 generally may be used with any firearm, such as handgun 102, having a barrel 104 and a grip 106, and optionally, a trigger 108. Additionally, although system 100 is described in various examples as being used with a handgun, one of skill in the art will appreciate that in various embodiments, the device may be used with any device requiring precision aiming, including lethal and non-lethal weapons such as: electroshock devices such as tasers, firearms having rubber, beanbag, wax, plastic, or other non-lethal impact rounds, shotguns, rocket launchers, cannons, automatic and semi-automatic weapons, crossbows, paintball guns, and non-lethal personal sidearms for chemical agents such as mace, tear gas, pepper spray, and offensive odor canisters.

As described in greater detail below, in some embodiments, system 100 may be configured as an integral part of a grip 106 of a handgun 102, such as for use with handguns 102 that have one or more removable grip panels 110. In other embodiments, system 100 may be configured to wrap around the front and/or rear of grip 106, for instance for use with handguns 102 that do not have removable or replaceable grip panels. As illustrated in FIG. 1, in various embodiments, laser component 114 may include a single housing for two or more lasers 116, for instance, one or more visible spectrum lasers 116*a* and one or more infrared spectrum lasers 116*b*, both of which may be configured for use as laser sights for handgun 102.

In various embodiments, laser system 100 may also include a master switch 120 for powering system 100 off and on, one or more activation switches 118 configured to activate one or more of the lasers 116, and a mode switch (not shown) configured to control which laser 116*a*, 116*b* is activated by activation switch 120, and therefore which laser 116 is used for sighting: the visible spectrum laser 116*a* or the infrared spectrum laser 116*b*. Although two lasers are shown in this embodiment, one of skill in the art will appreciate that systems for use in accordance with the present disclosure may be equipped with three, four, or even more laser diodes.

As described below in greater detail, in various embodiments, the two or more lasers 116 may be substantially pre-calibrated with respect to each other. Thus, in various embodiments, both (or all) lasers 116 may be calibrated simultaneously (e.g., aligned for windage and elevation) with respect to barrel 104 of handgun 102 by means of windage and elevation screws. In various embodiments, because the two (or more) lasers 116 are mounted together in a single laser component 114, only one of the lasers 116 needs to be calibrated (sighted or aligned) with respect to barrel 104; calibration of one laser 116 automatically calibrates the other laser(s). Thus, in various embodiments, infrared spectrum laser 116*b* may be easily calibrated without the use of night vision goggles simply by calibrating visible spectrum laser 116*a*.

In various embodiments, activation switch 118, which may be located adjacent to trigger 108, and which may be activated by pressure from a user's hand when preparing to fire firearm 102, may activate a selected laser 116, allowing the user to precisely aim firearm 102 at a desired target. Thus, in various embodiments, laser 116 may be activated automatically by a user when his or her grip tightens in preparation for firing, and no extraneous movements are required for activation that might interfere with the grip or firing stance.

FIGS. 2A and 2B are right (FIG. 2A) and left (FIG. 2B) side views of an exemplary laser aiming system configured for use with an exemplary handgun, in accordance with various embodiments. As illustrated in FIGS. 2A and 2B, in various embodiments, system 200 may include a laser component 214 having a single housing for two or more lasers (not shown) that may be simultaneously calibrated for windage and elevation with respect to barrel 204 of handgun 202 as described above with reference to FIG. 1. In various embodiments, system 200 also may include a master switch 220 for powering system 200 off and on, one or more activation switches 218 configured to activate one or more of the lasers 216, and a mode switch 222 configured to control which laser 216*a*, 216*b* is activated by activation switch 220. Although a particular embodiment of master switch 220 is illustrated in FIG. 2A, in various embodiments, master switch 220 may take the form of any type of manually operable electromechanical switch capable of controlling power to system 200. Similarly, although master switch 220 is illustrated as being located on the right side of grip 206, one of skill in the art will appreciate that it may be located in any position on handgun 202 that allows ease of use without interference with operation of handgun 202.

Additionally, in the illustrated embodiment, laser component 214 is a single component that may house both a visible light laser source, such as a red or green laser diode, and an infrared laser source, such as an infrared diode. Such laser sources are discussed in greater detail below. Although laser component 214 is illustrated as being a dual-aperture component located adjacent barrel 204 on the right side of handgun 202, one of skill in the art will appreciate that in other embodiments it may be located in any position that allows the beams from laser component 214 to be directed in a direction generally parallel with barrel 204 (see. e.g., beam 324 in FIG. 3. which is described in more detail below).

Additionally, in various embodiments, mode switch 222 also may take the form of any type of manually operable electromechanical switch capable of switching operation of system 200 from visible light mode (e.g., red or green laser) to infrared mode and vice versa, or between different colors of laser (e.g., between red and green lasers). Although mode switch 222 is illustrated as being located on the left side of grip 206, in various embodiments, it may be located in any position on handgun 202 that allows ease of use without interference with operation of the handgun. In some embodiments, for example, when located on the side of handgun 202, mode switch 222 may be operated with the non-dominant hand of the user, for instance, the hand not holding grip 206.

In other embodiments, mode switch 222 may be located adjacent trigger 208, so that it may be activated by the trigger hand of the user.

In various embodiments, activation switch 218 may take the form of any type of switch capable of activating system 200 to illuminate one or more lasers in laser component 214, and in various embodiments, activation switch 218 may be located adjacent to trigger 208 such that normal pressure from the gripping (e.g., trigger) hand of the user may activate system 200 and illuminate a laser beam. In various embodiments, the activation method of system 200 may be designed to integrate smoothly into the user's normal shooting technique such that the process of quickly and effectively engaging a threat is not disrupted or degraded. In various embodiments, activation switch 218 may conform to the user's natural grip, which does not have to break in any way. In fact, in various embodiments, the grip ergonomics may perform to the point that when the user's grip tightens to take a shot, the desired laser beam activates. In various embodiments, two or more activation may be provided that may be spaced apart on either side of grip 206, such that system 200 may be activated by pressure on grip 208 from either a right-handed or left-handed user. Particular embodiments of system 200 are designed for use with tactical gloves, and are MILSPEC 810G certified.

In some embodiments, some handguns, such as the M9 and M11, may be compatible with an over-mold-type system, such as those illustrated in FIGS. 1 and 2, in which system components may be integrated directly into one or more grip panels. Other handguns, such as those with polymer frames, may not have replaceable grip panels. Thus, in various embodiments, handguns such as the Springfield XD and the Glock 17 may be compatible with a grip wraparound-type version of the laser aiming system. In various embodiments, both types of systems may incorporate an activation switch adjacent to the trigger, holster compatibility, and overall excellent ergonomic performance.

Figure 3A:
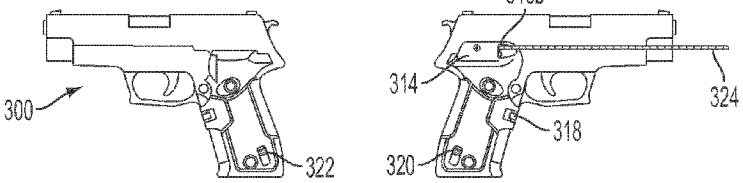
FIGS. 3A-3D illustrate state diagrams of a system having a master switch, and illustrates one example of how the master switch, mode switch, and activation switch work in concert to control operation of the laser aiming system, in accordance with various embodiments.
Figure 3B:
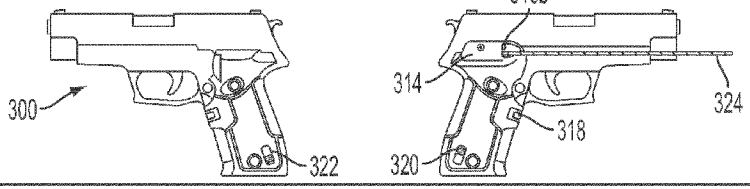
Figure 3C:
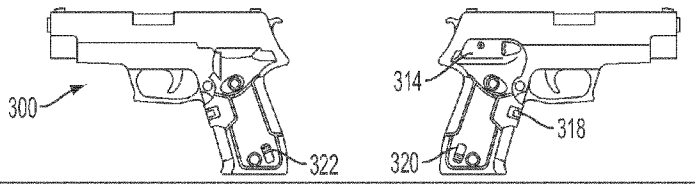
Figure 3D:
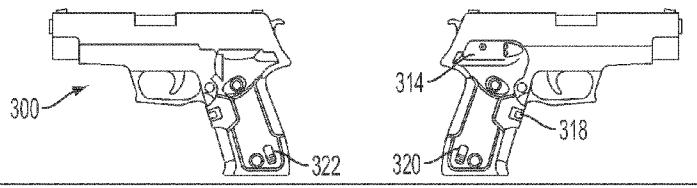
Figure 4A:
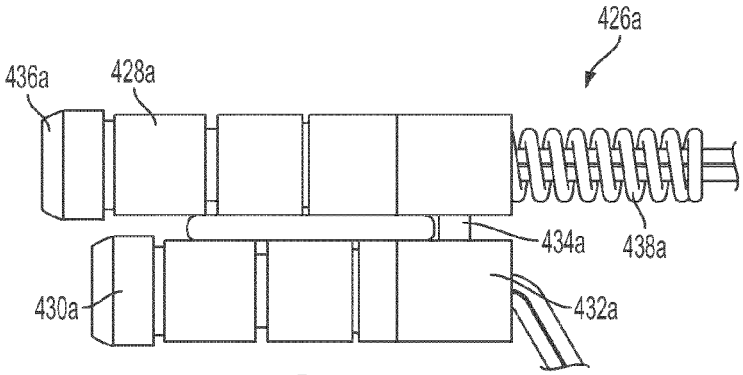
FIGS. 4A, 4B and 4C are ISO views of three different examples of a dual laser component, in accordance with various embodiments.
Figure 4B:
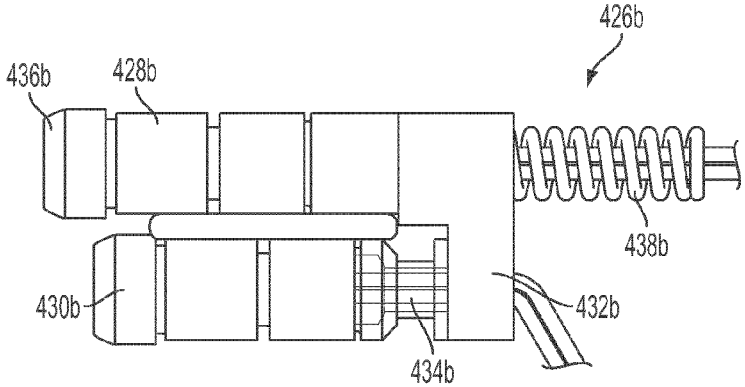
Figure 4C:
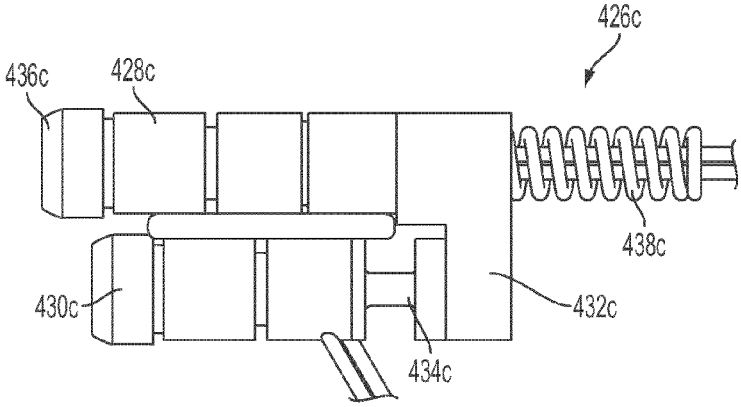

FIGS. 3A-3D illustrate state diagrams of a laser aiming system 300 having a master switch 320, and illustrates one example of how master switch 320, mode switch 322, and activation switch 318 may be adapted to work in concert to control operation of system 300. As shown in FIG. 3A, in some embodiments, when mode switch 322 is set to "red," master switch 320 is set to "on," and activation switch is depressed, red visible laser 316*a* may be activated. Conversely, as shown in FIG. 3B, in some embodiments, when mode switch 322 is set to "IR," master switch 320 is set to "on," and activation switch is depressed, infrared laser 316*b* may be activated. As shown in FIG. 3C, in some embodiments, when mode switch 322 is set to "red," master switch 320 is set to "off," and activation switch is depressed, no laser may be activated. Similarly, as shown in FIG. 3D, in various embodiments, when mode switch 322 is set to "IR," master switch 320 is set to "off," and activation switch is depressed, no laser may be activated.

As discussed above, in various embodiments, the laser component may house at least both a visible spectrum laser source, such as a red or green laser diode, and an infrared spectrum laser source, such as an infrared diode. Infrared lasers are invisible to the human eye, and in some embodiments may be configured for use with night vision goggles, which may be used to visualize infrared lasers during aiming and illumination procedures, for example. Visible lasers may include, in various embodiments, red and green laser beams, and generally are visible to the human eye. Generally, green lasers are much more visible than red lasers, but may be moderately larger in size. Green lasers also may benefit from the use of additional technology, for instance in order to achieve military acceptable environmental temperature range performance. Thus, in particular embodiments, the laser component may house at least both a red laser and an infrared laser. In specific, non-limiting examples, the wavelength of a red diode for use in accordance with the present disclosure may be 635 nm, and the wavelength of an infrared diode for use in accordance with the present disclosure may be 850 nm. In additional specific, non-limiting examples, the diode power of a red diode configured for use in accordance with the present disclosure may be 5 mW/Class 1, and the diode power of an infrared diode configured for use with the present disclosure may be 5 mW/Class 1. In further specific, non-limiting examples, the divergence of a red diode configured for use with the present disclosure may be 0.75 mrad×0.57 mrad, while the divergence of an infrared diode configured for use with the present disclosure may be 0.75 mrad×0.57 mrad.

FIGS. 4A-4C show three examples of a laser module 426*a*, 426*b*, 426*c* that may be housed inside the laser component, and that may include visible laser diode 428*a*, 428*b*, 428*c* and infrared laser diode 430*a*, 430*b*, 430*c*. In various embodiments, the two laser diodes 428*a*, 428*b*, 428*c* and 430*a*, 430*b*, 430*c* may be joined, in some embodiments, by a coupler or mounting member 432*a*, 432*b*, 432*c*, which may take any of a variety of forms, such as an H-shaped connector 432*a* or an L-shaped or stepped connector 432*b*, 432*c*. In various embodiments, the two laser diodes 428, 430 may be aligned with one another such that they produce overlapping laser beams at a predetermined distance when co-activated. In various embodiments, the two laser diodes 428, 430 also may be calibrated such that the laser beams they produce may be aligned with a projectile passing through the barrel, for instance at a predetermined distance, such as 25 feet, 50 feet, or 25 yards. In some embodiments, because the two laser diodes 428, 430, are coupled by mounting member 432, the laser aiming system may be further calibrated for windage and elevation by the user in a single step, for instance by calibrating the visible spectrum laser for windage and elevation, thereby simultaneously calibrating the corresponding infrared spectrum laser for windage and elevation.

Thus, the systems provided herein provide an advantage over conventional systems having two separate lasers, since in a conventional system, each laser must be separately adjusted for windage and elevation. This may be more difficult to accomplish with infrared lasers, because they must be calibrated in the dark using night vision goggles, which presents additional difficulties. However, because the systems disclosed herein use a pair of coupled laser diodes 428, 430, both visible spectrum diode 428 and infrared spectrum diode 430 may be calibrated in a single step with a single pair of windage and elevation screws.

In various embodiments, laser module 426 may include a yieldable member 434 that may allow coupled laser diodes 428, 430 to be pre-calibrated or aligned with respect to one another by causing yieldable member 434 to yield to a desired degree in a desired direction. For instance, in some embodiments, visible laser diode 428 may be held in a fixed position while tension is applied to infrared spectrum laser 430, causing yieldable member 434 to deform to a desired degree. In some embodiments, this procedure may be performed before laser module 426 is installed in the laser component. In various embodiments, yieldable member 434 may be sufficiently yieldable to deform to a desired degree under tension, but sufficiently rigid to then maintain a desired alignment between the lasers once aligned, even under firing pressures and harsh environmental conditions. In various embodiments, yieldable member 434*a* may be a component of mounting member 426*a*, as illustrated in FIG. 4A. In other embodiments, yieldable member 434 may form a portion of either of laser diodes 428, 430, or it may couple one of the laser diodes 428, 430 to mounting member 426, as illustrated in FIGS. 4B and 4C. In particular embodiments, the material and/or diameter of yieldable member 434 may be configured to achieve a desired degree of yieldability. For example, FIG. 4B shows a yieldable member 434*b* with a larger diameter, and so may be made form a softer or more yieldable material. Conversely, FIG. 4C shows a yieldable member 434*c* having a smaller diameter, and so may be formed from a harder or less yieldable material. In all of the embodiments described above, once yieldable member 434 has been deformed, and laser diodes 428, 430 are calibrated with respect to one another, both laser diodes 428, 430 may be calibrated (or sighted) simultaneously as needed in daylight simply by calibrating (sighting) the visible laser using conventional daylight procedures.

In various embodiments, the laser diodes, 428, 430 may be offset with respect to one another, such that one diode may project farther forward and may serve as a pivot point for purposes of adjusting windage and elevation. For example, in the illustrated embodiment, visible spectrum diode 428*a*, 428*b*, 428*c* may project farther than infrared spectrum diode 430, 430*b*, 430*c* (or vice versa), and may include a domed or otherwise curved surface 436*a*, 436*b*, 436*c* that may function as a pivot point within the laser component. In particular embodiments, a tensioning element, such as a spring 438*a*, 438*b*, 438*c*, may be included in a rear portion of the laser module that may serve to apply tension to hold curved surface 436*a*, 436*b*, 436*c* in position against a corresponding surface or window in the housing of the laser component. In use, in particular embodiments, windage and elevation screws (not shown) may be provided at right angles with respect to one another that may be configured to move mounting member 432, pivoting laser module 426 on curved surface 436 and calibrate both lasers simultaneously. Thus, in various embodiments, the system may include a very simple three-point calibration system that includes only two windage and elevation screws and a single tensioning spring.

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope. Those with skill in the art will readily appreciate that embodiments may be implemented in a very wide variety of ways. This application is intended to cover any adaptations or variations of the embodiments discussed herein. Therefore, it is manifestly intended that embodiments be limited only by the claims and the equivalents thereof.

What is claimed is:

1. A dual laser module for a firearm, comprising:

a mounting member;

a first diode coupled to the mounting member, the first diode having a first diode end extending along a first diode axis a first distance away from a first side of the mounting member;

a second diode coupled to the mounting member proximally to the first diode, the second diode having a second diode end extending along a second diode axis a second distance away from the first side of the mounting member, wherein the first distance is greater than the second distance, wherein the first diode end is shaped to act as an adjustment pivot to allow simultaneous adjustment of the first and second diode axes, and wherein the second diode couples to the mounting member via a yieldable connector.

2. The dual laser module of claim 1, wherein the first diode axis and the second diode axis are substantially parallel.

3. The dual laser module of claim 2, wherein the first diode axis and the second diode axis intersect at a distance of about 10-200 meters.

4. The dual laser module of claim 2, wherein the first diode axis and the second diode axis intersect at a distance of about 20-30 meters.

5. The dual laser module of claim 1, wherein the mounting member receives substantially all or part of the first and second diodes.

6. The dual laser module of claim 1, wherein the second diode axis is configured to be adjustable relative to the first diode axis.

7. The dual laser module of claim 1, wherein the dual laser module further comprises a three-point alignment system.

8. The dual laser module of claim 7, wherein the three-point alignment system consists of two set screws and a spring.

* * * * *